United States Patent [19]

Shore

[11] 3,947,981

[45] Apr. 6, 1976

[54] SCRAPER BOWL WITH HYDRAULIC SAFETY LOCK

[75] Inventor: Daniel B. Shore, Niles, Ill.

[73] Assignee: International Harvester Company, Chicago, Ill.

[22] Filed: Dec. 9, 1974

[21] Appl. No.: 530,796

[52] U.S. Cl. ..... 37/126 AE; 37/129; 91/414

[51] Int. Cl.[2] ..... E02F 5/00

[58] Field of Search ..... 37/126 AE, DIG. 8, 129; 91/414

[56] References Cited

UNITED STATES PATENTS

| | | | |
|---|---|---|---|
| 3,127,688 | 4/1964 | Hein et al. | 91/414 X |
| 3,150,568 | 9/1964 | Junck et al. | 37/126 R |
| 3,450,418 | 6/1969 | Rice | 37/126 R X |
| 3,797,140 | 3/1974 | McWilliams et al. | 37/129 |

*Primary Examiner*—Stephen C. Pellegrino

*Attorney, Agent, or Firm*—John W. Gaines; Floyd B. Harman

[57] ABSTRACT

Frame-drawn scraper having a bowl with hydrospring suspension and hydraulic pump, comprising: bowl raise-lower means disposed between and connecting the scraper draft frame and bowl; and an intervening hose, accumulator, and motion sensitive blocking safety valve connected in circuit in that order from the pump to the bowl means, responsive to extreme lowering movement of the bowl if the hose ruptures, to hydraulically lock the bowl from farther lowering by automatically blocking the circuit.

11 Claims, 4 Drawing Figures

SCRAPER BOWL WITH HYDRAULIC SAFETY LOCK

This application relates to a scraper with an hydraulic safety lock on the bowl. It more particularly relates to a scraper bowl provided with hydrospring suspension, including hose, an accumulator, and motion sennsitive safety valve connected in that order in a circuit leading to a bowl-raise-lower cylinder, and responsive to extreme groundward movement of the bowl, such as occasioned by ruptured hose, to hydraulically lock the bowl by automatically closing the circuit, through appropriate operation of the motion sensitive safety valve.

According to past practice, a moving scraper transports the loaded or unloaded bowl thereof, at an intermediate ride level hydraulically maintained at that level by a single or, preferably by a pair of, bowl cylinders. An accumulator, if provided in the line to the pair of cylinders or to the single bowl cylinder, imparts hydrospring suspension action to the bowl cylinder and, in any case if the line ahead of the accumulator loses hydraulic pressure, the bowl will penetrate into the ground like a lever or pole implanting itself at the leading end. The problem in an exaggerated case can be that the scraper will overturn by flipping over forwardly.

In the situation in which the hydraulic pressure loss is only temporary, the accumulator will aggravate the situation, for the reason that the bowl can penetrate even deeper because of the ensuing dynamic disturbance in its elastic suspension.

My invention of an hydrospring suspension with automatic accumulator fill and with automatic hydraulic safety lockup materially reduces if it does not substantially eliminate the foregoing problem, as will now be explained in detail. Features, objects, and advantages will either be specifically pointed out or become apparent when, for a better understanding of the invention, reference is made to the following description, taken in conjunction with the accompanying drawings which show a preferred embodiment thereof and in which.

Figure 1:
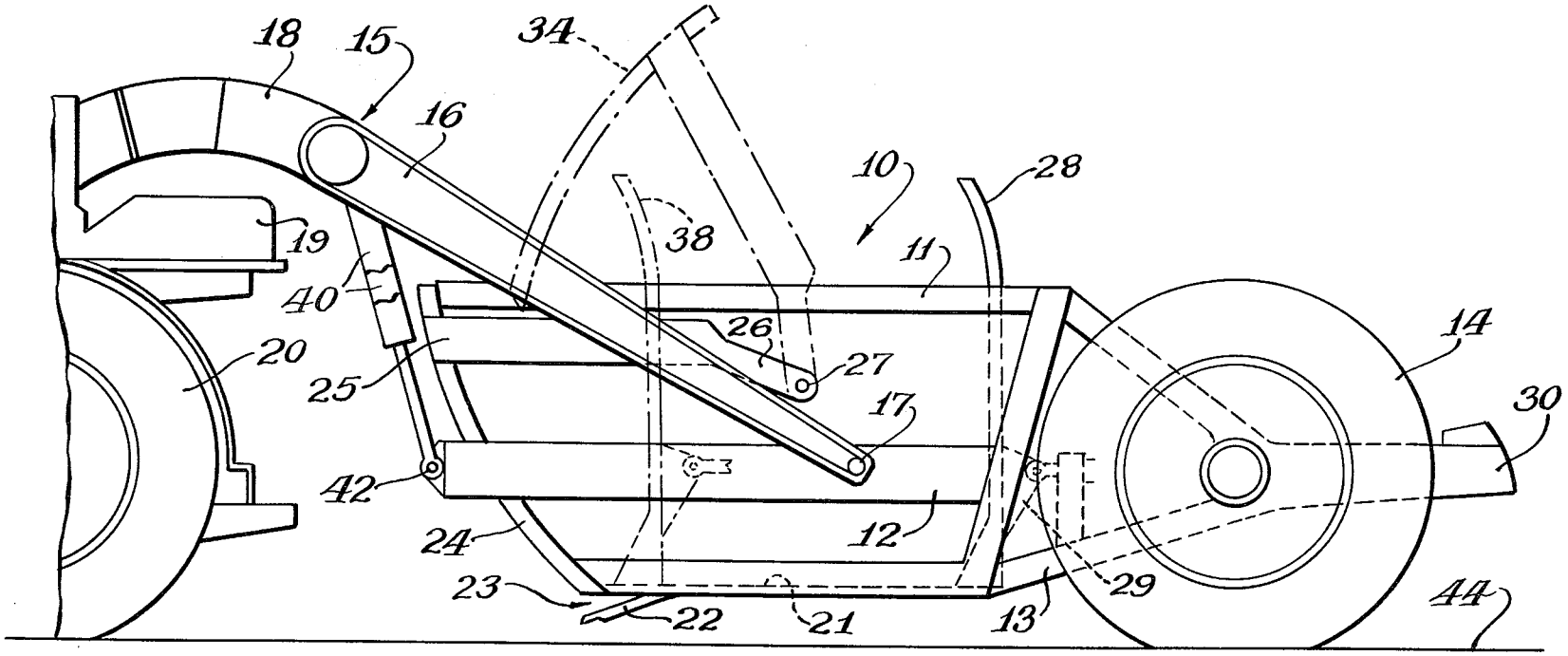
FIG. 1 is in elevation, as viewed from the left side of a tractor scraper combination embodying the hydraulic system of the present invention.

More particularly in FIG. 1 of the drawings, a scraper 10 is shown including a scraper bowl 11 carried by a supported scraper frame 12. A rear portion 13 of the scraper frame 12 carries two ground wheels 14 on which the frame is pivoted at the rear for moving the bowl up and down.

A draft frame 15 includes left and right side arms 16 having pivot connections 17 to the scraper frame 12 at intermediate, horizontally opposed points at the sides. A front gooseneck portion 18 of the draft frame 15 is connected through a trailer hitch to a two-wheel tractor 19 having its wheels shown at 20. The tractor carries an engine and renders the tractor-scraper combination self-propelled.

The cutting edge 22 of the bowl floor will be on the movable floor section if the floor has fixed and movable sections, not shown, or as illustrated the simpler fixed floor 21 has the cutting edge 22 at its forward end. The cutting edge 22 extends laterally across the front of the bowl and in effect provides a discharge end 23. The discharge end 23 is normally closed by a bowl apron 24 having side arms 25. Fixed rear ends 26 of the side arms 25 are secured to the bowl 11 by pivots 27 establishing on the bowl a horizontal fixed pivot axis.

One commercially available type of bowl with fixed and movable floor sections is covered by U.S. Pat. No. 3,325,925. The moving bowls scrape up material and are filled in that way.

The bowl 11 has a vertically disposed ejector gate 28 which carries an actuating bracket 29 and which is movable thereby from a rearward or retracted position, forwardly to a discharge position for discharging material through the discharge end 23. The rear portion 13 of the scraper frame 12 carries a reinforced stinger or bumper 30 at the rear by which the scraper is sometimes pushed.

For discharge, the apron 24 is pivoted into an upper or open position as shown by the broken lines 34 in FIG. 1. Then the ejector 28 is linearly moved into an advanced position as shown by the broken line 38, and the bowl 11 thus empties.

The bowl 11 has a depending pair of hydraulic raise-lower cylinders 40 pivoted on a head end connection, not shown, on the draft frame 15 and pivoted on a rod end connection 42 to the bowl frame 12 at the front. In the position shown in FIG. 1, the bowl 11 is in a non-contact median ride position relative to ground level 44. Extending movement of the bowl cylinders 40 causes bowl motion from the median position successively through a lo lock up position, a minimum carry position, and a ground contact position, thence through dig positions into a maximum dig position below ground. Conversely, foreshortening movement of the bowl cylinders 40 moves the bowl from the median position upwardly through a hi lock position, thence into a maximum raise position. For another purpose, the full sequence of numbered bowl positions is lettered-in on FIG. 4.

HYDRAULC SYSTEM COMPONENTS — FIG. 2

Figure 2:
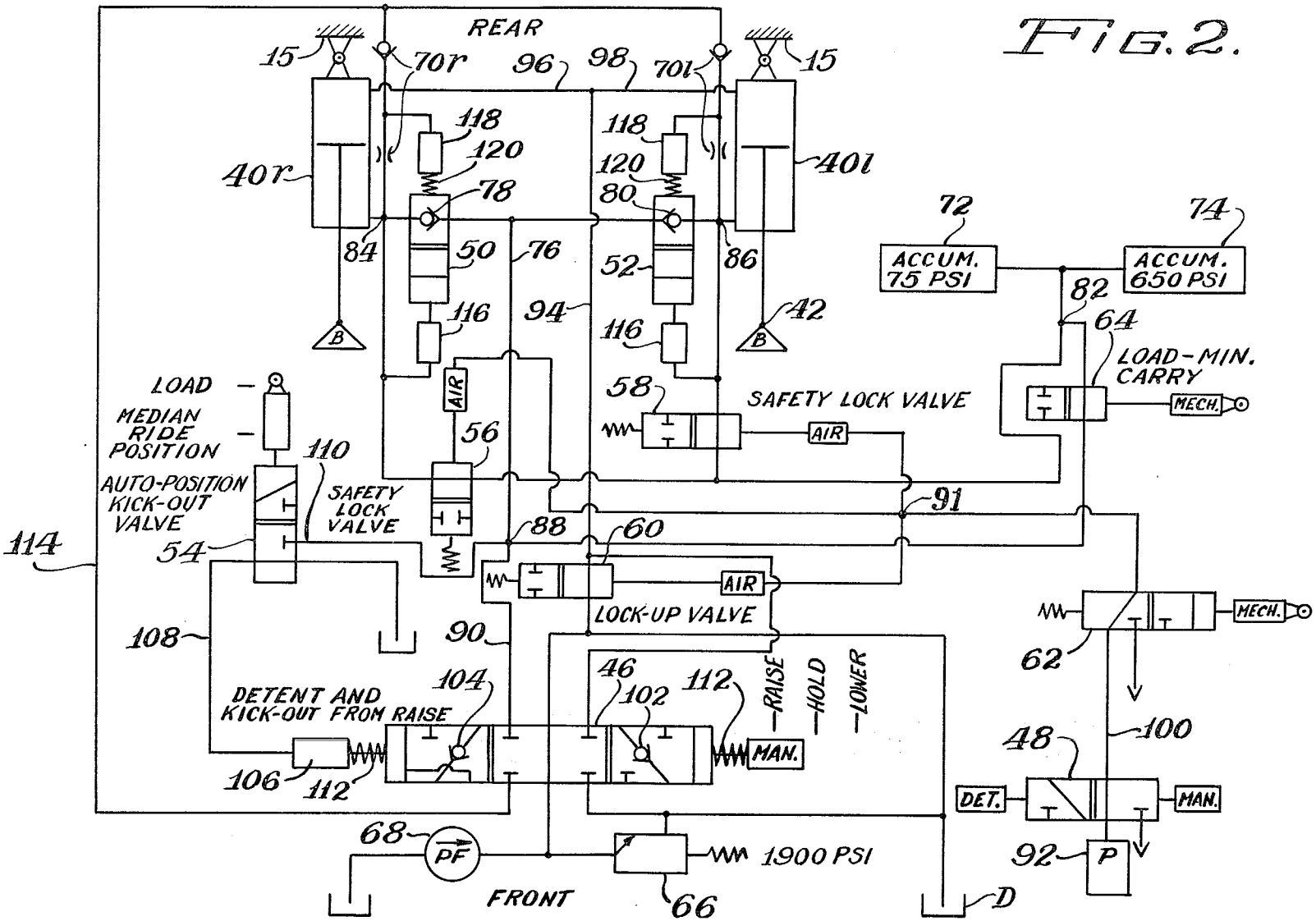
FIGS. 2 and 3 are schematic diagrams of the hydraulic suspension system with the valves set respectively for hydrospring suspension and for lockup of the bowl.

The system incorporates various valves as used in the hydrospring suspension, and also as used for controlling for proper ride of the bowl cylinders, which are subscript-differentiated in FIG. 2 by $40_r$ for right and $40_l$ for left, for example.

The cab valves, i.e., operator-operated valves provided in the cab of tractor 19, are designated as follows:

| | |
|---|---|
| Raise-lower 46 | Suspension-lockup 48 |

The rest of the valves are either flow piloted, automatic positioning, air piloted, relief, or cam operated, and specifically designated as follows:

| | |
|---|---|
| Oil-piloted, right 50 | Lockup, upward 60 |
| Oil-piloted, left 52 | Pilot 62 |
| Automatic positioning 54 | Load-minimum carry 64 |
| Safety lock, right 56 | Pump bypass 66 |
| Safety lock, left 58 | |

Further components are designated as follows:

| | |
|---|---|
| Hydraulic pump 68 | Accumulator lo rate 72 |
| Restriction-check line $70_r$ | Accumulator hi rate 74 |

-continued

Restriction-check line $70_l$

HYDROSPRING SUSPENSION — FIG. 2

As between the two bowl conditions, suspension or lockup, the suspension condition obtains when the valves are in the settings as shown in FIG. 2. The status of the hydraulic fluid lines is as follows.

A 1st circuit 76 has a right cylinder branch including a flow sensitive right check valve 78 leading to the rod end of the bowl cylinder $40_r$, and a left cylinder branch including a flow sensitive left check valve 80 leading to the rod end of the bowl cylinder $40_l$. The valves 78 and 80 have a seated position, functioning as lock valving to lock the bowl cylinders at the rod (lower) end.

A 2nd circuit 82 splits into a right cylinder branch including the right safety lock valve 56 leading into the rod end of the bowl cylinder $40_r$, and a left cylinder branch including the left safety lock valve 58 leading into the rod end of the bowl cylinder $40_l$. The downward load of the bowl indicated at B exerts an extensible force on the bowl cylinders, the rod ends of which communicate through the safety lock valves to the lo rate and hi rate accumulators 72, 74. The accumulators are of the pneumatic type charged to different nitrogen pressures, affording proper differing spring rates to elastically suspend the bowl both when loaded and unloaded. Hydrosprings employing unequally preloaded mechanical springs can be used to equal advantage as the accumulators.

The right cylinder branch of the 1st circuit 76 and the right cylinder branch of the 2nd circuit 82 form a right branch juncture 84 from which a common portion of the two branches leads into the rod end of cylinder $40_r$. Similarly, a common left branch juncture 86 communicates with the rod end of cylinder $40_l$ through a common branch portion.

The 1st and 2nd circuits 76 and 82 are hydraulically in parallel and have a common juncture 88, reached in the 2nd circuit 82 through the load-minimum carry or fill valve 64. The bowl-raise hose 90 between the tractor cab and the scraper interconnects the operator-operated raise-lower valve 46 and the common circuit juncture 88 so as to be in common to the 1st and 2nd circuits. The valve 46 in FIGS. 2 and 3 has three positions, and is shown in the centered position blocking the bowl-raise hose 90 and the 1st and 2nd circuits 76 and 82.

SECOND LOCK VALVING — FIG. 2

Figure 3:
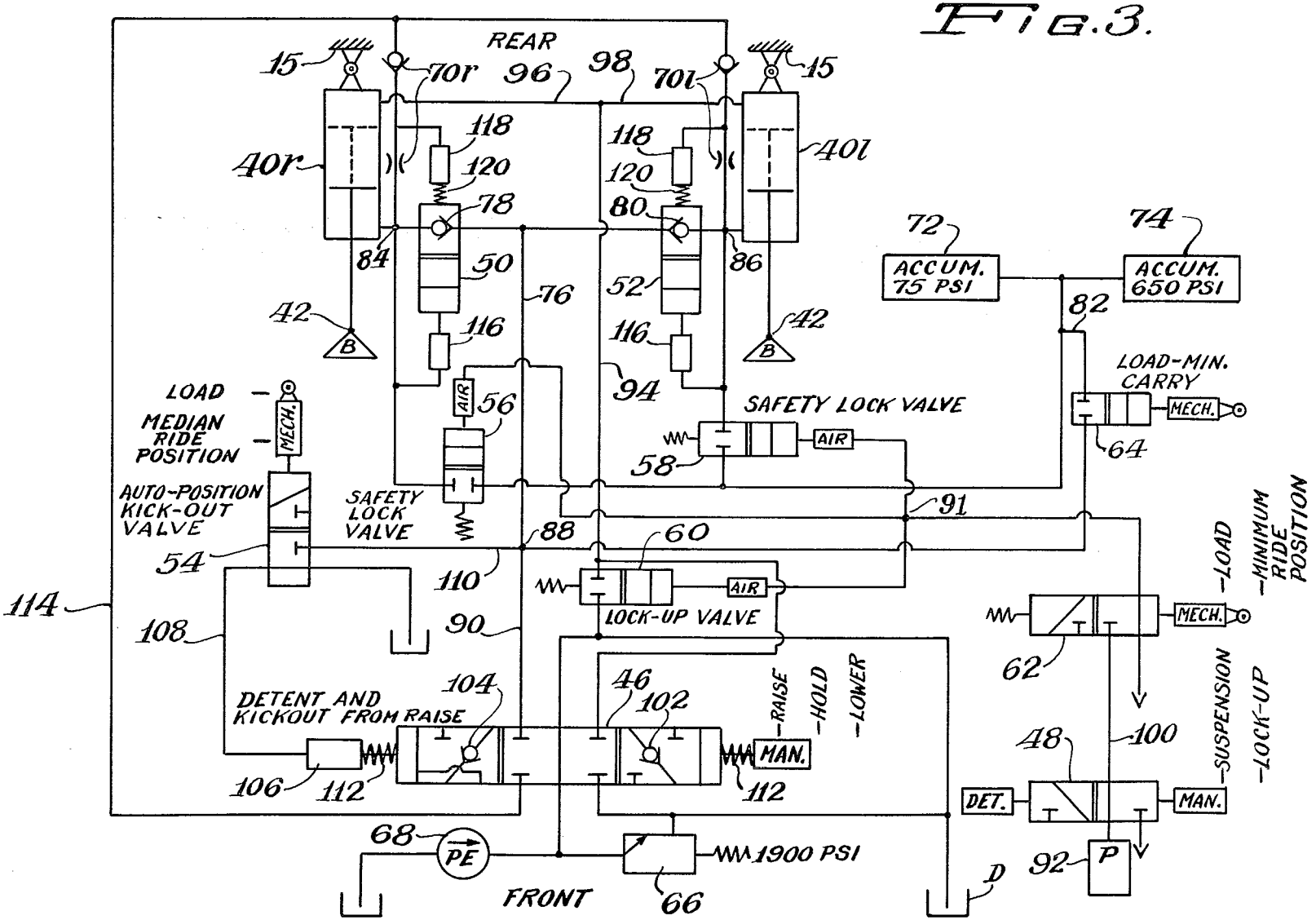

Besides the referred to 1st lock valving function of the flow sensitive right and left check valves 78 and 80, a 2nd lock valving function is afforded by the right and left safety lock valves 56 and 58. Specifically, the valves 56 and 58 share (with upward lockup valve 60) the pilot valve 62, which is operated to control piloting air through an air-line junction 91 to the piloted valves 56, 58 and 60 and which renders them motion sensitive to the bowl. For control purposes, the pilot valve 62 establishes inter-communication either with its connection to a vent V or to a source 92 of air pressure P. When the intercommunication is to the vent V as shown in FIG. 3, the piloted valves 56 and 58 are caused by the valve 62 to be vented of their piloting air and to take their lockup positions as shown.

DOWNWARD LOCKUP — FIG. 3

Being sensitive in this way to groundward movement of the bowl load B into the referred to bowl minimum carry position, the right and left safety lock valves 56 and 58 hydraulically lock the bowl cylinders 40 safely at the rod end and ensure against the bowl making ground contact. The cylinders 40 are shown in solid lines in FIG. 3 in an appropriately extended position being held in safety lockup and, obviously, the functions of both the 1st lock valving and the 2nd lock valving are essential.

UPWARD LOCKUP — FIG. 3

The bowl load B can be hydraulically raised by bringing the bowl cylinders 40 into an appropriately foreshortened condition at which the bowl load B reaches an upward point corresponding to the broken line, retracted position shown for the pistons within the bowl cylinders 40. At that point, the pilot valve 62 will take the position as shown in FIG. 3, causing the piloting air to the upward lockup valve 60 to be vented so as to cause hi lockup.

That is to say, the upward lockup valve 60 will shift from a position venting the bowl cylinders 40 at the head end into a lockup position as shown in FIG. 3, closing a bowl-lower service line 94 and blocking it from drain. The service line 94 splits into a right branch 96 and a left branch 98 leading to the respective bowl cylinders $40_r$ and $40_l$ at the head end.

Further raise movement of the bowl cylinders 40 is interrupted at the attained hi lockup position thus affording an automatic hydraulic stop, overcome only by farther upward raising which the operator can cause by shifting the raise-lower valve 46 into a raise position according to the indicia appearing in FIG. 3.

MANUAL LOCKUP — FIGS. 2 and 3

In changing between the bowl suspension condition and the bowl lockup condition, it is essential in order to attain the latter condition that the upward lockup valve 60 be changed from the position as shown in FIG. 2 so that it will stop venting the bowl cylinders at the head end, and that the safety lock valves 56 and 58 be changed from the position as shown in FIG. 2 in order to block communication between the accumulators and bowl cylinders 40 at the rod end. Moreover, despite the fact that the pilot valve 62 can continue to occupy the position as shown in FIG. 2 to sustain suspension condition, the suspension-lockup valve 48 can be shifted by the operator in the cab from the position as shown in FIG. 2 into a piloting air venting position and establish lockup. In other words, when the suspension-lockup valve 48 is shifted from the position shown in FIG. 2, it vents an air supply line 100 normally supplying piloting air to the pilot valve 62 and to the piloted valves 56, 58, and 60. So the piloted valves because of venting take the positions as shown in FIG. 3 and the bowl suspension is locked up.

VALVE 46 MANUAL POSITIONING — FIGS. 2 and 3

The operator operates the raise-lower valve 46 in the tractor cab to hydraulically move the bowl anywhere between and including maximum dig position and maximum raise position, irrespective of whether a suspension condition is encountered as in FIG. 2 or the lockup condition prevails as in FIG. 3. From any position below maximum raise, the operator can raise the bowl thereto by manually shifting the valve 46 to the left into its raise position.

From any position above maximum dig, the operator can lower the bowl under power to maximum dig position by shifting the raise-lower valve 46 from the position as shown in FIG. 2 rightwardly into a bowl-lower position. Either way, one of the two lines 90 and 94 is connected to pressure from the pump 68 by means of the valve 46 via the conduit (FIG. 2) leading to the latter from pump 68, and the other is connected by the valve 46 to drain D. A load check valve 102 and a load check valve 104, respectively, in the raise and lower sections of the valve 46, ensure against flow reversal in the pressure line which might allow the bowl to drop temporarily while the valve is moving between positions.

VALVE 46 AUTOMATIC POSITIONING — FIGS. 2 and 3

From any position below median ride position of the bowl, the bowl can be automatically raised to and stopped at the median position by first shifting the raise-lower valve from the position shown, leftwardly into the raise position. A spring operated detent 106 automatically latches the valve 46 in the raise position, and has a kickout oil line 108 which is inactive when, as shown, it is vented to drain by the automatic positioning valve 54.

With the valve 46 thus detented, the bowl will rise toward median ride position, to which the automatic positioning valve 54 is motion sensitive so as to shift from the position as shown in FIG. 2 into the median ride position according to the indicia. Pump pressure thus communicates with the detent 106 in a path leading from the juncture 88, through an automatic positioning valve line 110 and valve 54, thence through the previously inactive kickout oil line 108 into the detent 106 so as to supply it with kickout oil. The detent undergoes kickout, and the raise-lower valve is automatically recentered to hold position by centering springs 112 at the opposite ends.

FILL LIQUID FROM VALVE 64 — FIG. 2

When operation by the valve 46 in the way just described causes the bowl to be raised from any point below its minimum carry position upward progress of the bowl to that position causes the motion sensitive, load-minimum carry valve 64 to be shifted into the position as shown in FIG. 2. The piloted valves 56, 58, and 60 at the time will, in the described way, occupy the lockup position as shown in FIG. 3 and, normally, the pneumatic accumulators 72 and 74 will have an insufficient volume of oil present therein to match the pressure in the bowl cylinders 40 at their rod end.

Consequently, the right and left flow sensitive valves 78 and 80 will be seated in the flow piloted valves 50 and 52, and the pumped output temporarily will be diverted to flow in a 2nd circuit path leading from the pump 68, through the raise section of valve 46, the hose 90, juncture 88, thence through the load-minimum carry valve 64 in the 2d circuit 82 and into the accumulators 72 and 74. The referred to 1st lock-valving-function at 78 and 80 will prevent groundward movement of the scraper bowl. Enough fill liquid will be added to the accumulators with the bowl so locked as to pressurize them to the rod end pressure of the bowl cylinders 40. After the pressures equalize throughout the 1st and 2nd circuits, flow will be restored in the 1st circuit 76, through the now unlocked flow sensitive valves 78 and 80, and will restore the raising operation by filling the rod ends of the bowl cylinders 40, following the delay during the temporary diversion.

BOWL LOWER — FIGS. 2 and 3

From any point above maximum dig position, the bowl can be lowered thereto by operator operation of the valve 46 into the bowl-lower position. Fluid delivered by the pump 68 flows from the raise-lower valve 46 in a path through the 2d circuit 94, thence through the right and left branches 96 and 98 into the bowl cylinders 40 at the head end. Fluid being displaced from the rod end of the bowl cylinders initially flows in small quantity but at a substantial velocity from the rod ends, through the junctures 84 and 86, the restriction-check lines $70_r$ and $70_l$, and a raise-lower valve hose 114, thence through the bowl-lower (left section) of the valve 46 to drain D. Oil flow in lines $70_r$ and $70_l$ creates a pressure differential, and the oil piloted valves 50 and 52 are rendered flow sensitive by tapped-in upstream cylinder devices 116 which exert a shifting force. That force prevails over opposing downstream cylinder devices 118 and return springs 120 controlling the piloted valves 50 and 52.

The oil force thus exerted shifts the valves 50 and 52 from the position as shown in FIG. 3, into positions opening the bowl cylinders 40 at the rod end for substantial outflow. Specifically, the outflow is in a path from the rod end of the bowl cylinder 40, through the junctures 84 and 86, the oil piloted valves 50 and 52, the 1st circuit 76, the juncture 78, and the hose 90, thence through the left section of the raise-lower valve 46 directly into drain D.

The bowl cylinders 40 establish a power down lowering of the bowl down to and including the maximum dig position if desired. They hold the bowl there when the valve 46 is recentered to hold position, and there is no outflow from the cylinder ends.

The valves 50 and 52 are each as physically close to the cylinder concerned as mechanically possible. When flow is slow or stops in lines $70_r$ and $70_l$, the springs 120 automatically shift the valves 50 and 52 into the appropriate positions which are identically shown in FIGS. 2 and 3.

MOTION SENSITIVE VALVES — FIG. 4

Schematically shown, a cam assembly 122 moves in the opposite directions indicated by an arrow 124 in correspondence with bowl movement because of a connection, not shown, to the latter. A position pointer PP on the assembly takes positions at points along a fixed scale bearing indicia which precisely correspond to the bowl positions heretofore described. The cam action can be rotary, if rotary cams are used, or else linear as schematically shown.

Oriented in parallel to the movement of the cam assembly are a first protruding cam surface 126 thereof for controlling fill liquid into the accumulators, a depressed cam surface 128 for establishing the suspension condition of the bowl, not shown, and a second protruding cam surface 130 for bowl automatic positioning. With upward bowl movement, the cam assembly 122 will move and carry the cam surfaces upwardly as viewed in FIG. 4, and vice versa.

MOTION SENSITIVE OPERATION — FIG. 4

Figure 4:
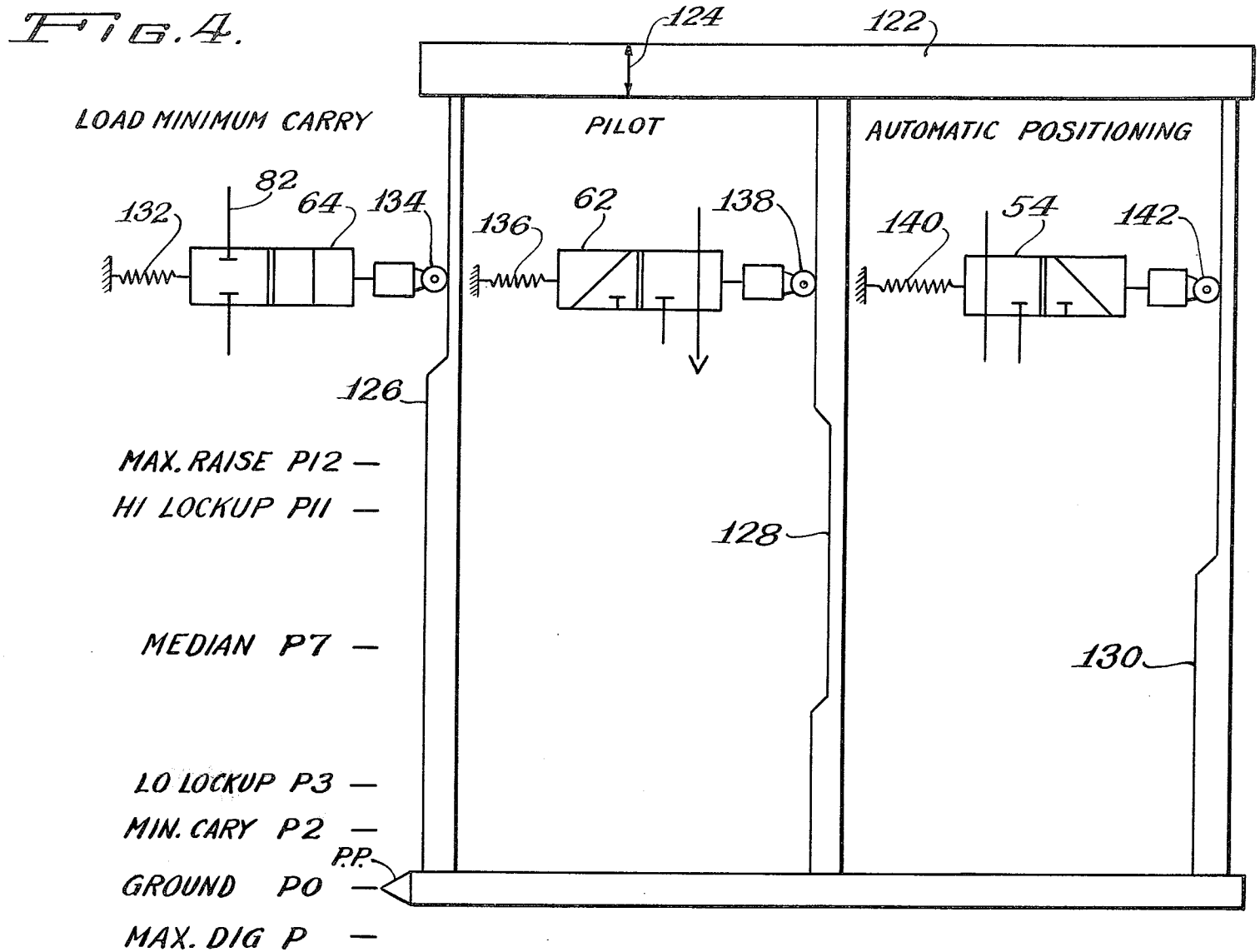
FIG. 4 is a longitudinal elevational showing of bowl-connected cams for setting the valves.

A cam ramp at the upper end of the fill liquid initiating surface 126 becomes active in the minimum carry position of the bowl, in effect establishing a bowl range therebelow and a bowl range thereabove. When the bowl is below minimum carry position, for example in ground position as will be indicated by the position pointer PP on the scale when it is at the ground point PO, an isolating spring 132 functions to isolate the accumulators, not shown, with the load-minimum carry valve 64 shifted into the accumulator blocking position as shown in FIGS. 3 and 4. But with the bowl in the range above the minimum carry position as indicated by the position pointer PP when it is above the minimum carry point P2 on the scale, a cam roller 134 functions to put fill liquid into the accumulators, with the valve position shifted by the roller on the cam surface 126 and with the load-minimum carry valve 64 in the accumulator liquid fill position as shown in FIG. 2 to match rod end pressure.

The piloting-air cam surface 128 is active when the bowl is at an intermediate range between hi and lo lockup position, as indicated on the scale by the position pointer PP being in the range above the lo lockup point P3 and below the hi lockup point P11. When the bowl enters that range, an unlocking spring 136 functions to establish the suspension condition of the bowl, with the pilot valve 62 shifted into the position as shown in FIG. 2 cutting in the charged accumulators to the system. The pilot valve 62 also functions to unlock the lockup valve 60, FIG. 2, so that, as shown, it will vent the bowl cylinders 40 at the head end. When the bowl is out of the hi and lo lockup range, as indicated on the scale by the position pointer PP being below the lo lockup point P3 or above the high lockup point P11, ramps at the opposite ends of the depressed surface 128 intervene and prevent the depressed surface 128 from longer being active. A cam roller 138 on valve 62 is shifted by the ramp concerned and functions to lock up the bowl cylinders, with the pilot valve 62 shifted into the piloting-air venting-position as shown in FIGS. 3 and 4.

A ramp at the upper end of the automatic positioning cam surface 130 becomes active when the bowl reaches the median ride position, in effect establishing a bowl range therebelow and a bowl range thereabove. When the bowl is in the range below the median position, as indicated on the scale by the position pointer PP being for example at the ground position point PO, a valve hold spring 140 functions to detent the raise setting of the system with the automatic positioning valve 54 shifted into the position as shown in FIGS. 2, 3, and 4. The bowl keeps rising.

But when the bowl is above the median ride position, a kickout cam roller 142 on the automatic positioning valve 54 is ramped onto the cam surface 130 and functions in kickout, with the automatic positioning valve 54 shifted from the position as shown in FIGS. 2, 3, and 4 into an automatic positioning causing the system to be released from the bowl-raise valve setting. The bowl is stopped.

SCRAPER CYCLE

Between the work site at which the scraper is loaded and deposit site at which the scraper is unloaded, the self-propelled tractor-scraper moves in a circuit, transporting the scraped material and being empty upon return.

In proceeding to the work site, the scraper will have an unloaded bowl. The suspension-lockup valve 48 is kept generally in the suspension position as shown in FIG. 2, and the empty bowl will be riding at median ride level with the valves positioned as shown in FIG. 2, to wit, the valves 46, 50, 52, 54, 56, 58, 60, 62, 64, 78, and 80. The resulting suspension condition of the bowl will be maintained primarily by elasticity of the lo spring rate accumulator 72.

In the working area at the site, the scraper will make a scraping pass in essentially a straight steered line. At outset, the operator operates the raise-lower valve 46 into bowl-lower and hold positions in sequence, establishing lockup of the bowl with its cutting edge 22 below ground at the dig level desired. The bowl fills by the end of the scraping pass and the load is retained in the space between the lowered apron 24 at the front and the retracted ejector gate 28 at the rear.

At the end of the scraping pass, the operator shifts the raise-lower valve 46 into bowl-raise position and releases valve 46, which remains in the bowl-raise position because of the spring operated detent 106. The bowl elevates past ground level position as indicated on the scale by the position pointer at point PO as shown in FIG. 4, and continues rising. In moving past the minimum carry position indicated by the position pointer PP passing the minimum carry point P2 on the scale, the bowl by causing movement of the cam assembly 102 cams the load-minimum carry valve 64 into liquid fill position. The bowl stops until the valve 64 fills liquid into the accumulators 72 and 74 and then the bowl resumes rising.

When the bowl passes lo lockup position as indicated on the scale by the position pointer PP passing the lo lockup point P3, the cam assembly 122 cams the pilot valves 62 to cut in the accumulators and cut in the venting of the bowl cylinders 40 at their head end. The suspension condition is established for the loaded bowl.

When the bowl rises to the median position as indicated on the scale by the position pointer PP being at the median point P7, the cam assembly 122 cams the automatic positioning valve 54, causing it to take a kickout shift and undetent the valve 46 which recenters in hold position.

The loaded scraper moves off the work site, with the bowl loaded in suspension condition at median ride level. Elasticity in the bowl suspension is primarily provided by the hi rate accumulator 74.

The scraper proceeds to the deposit site, is unloaded by coaction of the apron 24 and ejector 28 in the way described, and then returns unloaded to the work site with the bowl empty, in suspension condition and carried at median ride level.

The cycle is then repeated.

It will be appreciated that when the bowl is in suspension condition at the median ride level, the limits of its movement are established at hi lockup and at lo lockup by an hydraulic stop action. Mechanical stops and mechanical safety devices which are therefore unnecessary are not provided. The hydraulic stops are particularly advantageous during the bowl-loaded condition when the hi spring rate accumulator 74 is providing elasticity for bowl suspension and the strength requirements are most stringent.

As herein disclosed, the tractor cab carries the raise-lower valve 46 and the suspension-lockup valve 48, whereas at the minimum the scraper carries the oil piloted valves 50 and 52, the air piloted safety lock valves 56 and 58, and the motion actuated positioning, minimum ride, and minimum carry valves 54, 62, and 64. Also as herein disclosed, the lines 90 and 114 are hose. But it is not essential and only illustrative that lines 90 and 114 are hose, although it is essential that two or more pieces of hose at the minimum be used as connections between the cab carried valves and the scraper carried valves. In any case, breakage of any hydraulic or other line herein which is under pump pressure will not incur losing bowl control because the present safety devices automatically introduce hydraulic stops to prevent extreme or uncontrolled bowl movement.

Variations within the spirit and scope of the invention described are equally comprehended by the foregoing description.

What is claimed is:

1. In a frame-drawn scraper having a bowl with hydrospring suspension and hydraulic pump, comprising a 1st circuit operatively connecting the hydraulic pump to bowl raise-lower means, said bowl raise-lower means disposed between and connecting the scraper draft frame and said bowl whereby the bowl is moved in the direction away from the ground when the bowl raise-lower means is activated and can move in the groundward direction, and a 2nd circuit with accumulator means therein, hydraulically disposed between the hydraulic pump and bowl raise-lower means, to connect the accumulator means in circuit therewith;

the improvement characterized by:

the circuits including hose forming a portion in common to the two circuits, said circuits being connected hydraulically in parallel from said common hose portion to the bowl raise-lower means, the parallel portion of the 2nd circuit including said accumulator means;

1st lock valving connected in the 1st circuit between the hose and bowl raise-lower means; and 2nd lock valving connected in the 2nd circuit between the accumulator and bowl raise-lower means;

said valving having condition sensing means including operative connections to the bowl rendering each sensitive to a condition to responsively block flow in the respective circuits, effectively as a safety lock for automatically hydraulically stopping the bowl from unwanted extreme movement.

2. The invention of claim 1, characterized by:

said valving sensing means and connections to the bowl comprising motion sensing means rendering the 2nd valving motion sensitive for safety lockup of the bowl raise-lower means in response to bowl movement caused, including groundward movement caused by hydraulic losses from hose rupture.

3. The invention of claim 2, further characterized by:

said valving sensing means and connections to the bowl comprising flow sensing means rendering the 1st valving flow sensitive to prevent, from unwanted bowl lowering movement, outflow of hydraulic fluid from the bowl raise-lower means back into the 1st circuit.

4. The invention of claim 2, the 2nd valving characterized by:

valving and accumulator unlocking means (spring 136) operatively connected to the bowl for activating the valving and accumulator means, and responsive to bowl movement into an intermediate range rendering the accumulator means effective in the 2nd hydraulic circuit for hydrospring suspension and rendering the valving extreme-motion-sensitive.

5. The invention of claim 4, further characterized by:

a valve actuator (138) connected to the bowl so as to be operated as the bowl moves;

said 2nd valving consisting of at least one piloted valve and having pilot means connecting same to the actuator for motion sensitivity.

6. The invention of claim 4, further characterized by:

means (48) connected to the unlocking and accumulator means to render same ineffectual for hydrospring suspension.

7. The invention of claim 4, further characterized by:

fill valve means (64) connected in the 2nd circuit between the hydraulic pump and accumulator means, said fill valve means having condition sensing means including operative connections to the bowl rendering the fill valve means sensitive to a condition just preceding intermediate bowl movement, and effective to fill liquid into the accumulator means and produce hydrospring suspension pressure.

8. The invention of claim 5, further characterized by:

the 1st and 2nd circuits having a conduit portion in common from the hydraulic pump output;

a raise-lower valve in said common conduit portion to operate the bowl raise-lower means, said valve having a hold position and a raise position from which it can be shifted into the hold positions, and having motion sensitive kickout means connected to the bowl for automatically shifting the valve from raise to hold position at median ride level of the bowl.

9. The invention of claim 8, further characterized by:

a lower service line (94) between the raise-lower valve and the bowl raise-lower means; and a piloted valve (60) in said line for establishing communication with drain, and having said pilot means interconnecting said valve and the actuator for hydraulically intercommunicating said line and drain in response to bowl movement into intermediate range.

10. A frame-drawn scraper having a bowl with hydrospring suspension, comprising:

bowl raise-lower means (40) disposed between and connecting the scraper draft frame and bowl;

an hydraulic pump therefor; and intervening hose, accumulator, and motion sensitive blocking safety valve means connected in circuit in that order from the pump to the bowl means, said motion sensitive blocking safety valve means connected to, and responsive to extreme lowering movement of, the bowl occasioned by conditions, including hose rupture, to hydraulically lock the bowl from farther lowering by automatically blocking the circuit.

11. In a frame-drawn scraper having a bowl with hydrospring suspension, comprising an hydraulic pump, a 1st circuit operatively connecting the hydraulic pump in a 1st circuit path to bowl raise-lower means, said bowl raise-lower means disposed between and connecting the scraper draft frame and said bowl whereby the bowl is moved in the direction away from the ground when the bowl raise-lower means is activated and can move in the groundward direction, and a 2nd circuit provided with accumulator means therein, and hydraulically disposed between the hydraulic pump and bowl raise-lower means to connect the accumulator means in circuit therewith;

the improvement characterized by:

the circuits connected hydraulically in parallel;

1st valving means;

movement sensitive lock valving connected in the 2nd circuit between the accumulator and bowl raise-lower means, said lock valving connected to the bowl and having unlocking means (spring 136) effective under the condition of bowl movement into an intermediate level range so as to render the accumulator means effective in the second hydraulic circuit for hydrospring suspension; and diverter valve means connected in the 2nd circuit between the hydraulic pump and accumulator means, said diverter valve means having connections to the bowl and sensitive to a condition just preceding intermediate bowl movement and effective to direct hydraulic fluid, diverted from the path to the bowl means, into the accumulator means to ensure buildup of hydrospring suspension pressure prior to unlocking action of the 2nd valve unlocking means;

said 1st valving means connected in the 1st circuit to prevent flow reversal therein whilst the flow of fluid diverted is directed to ensure buildup of hydrospring suspension pressure.

* * * * *